US008563923B2

(12) United States Patent
Satoh

(10) Patent No.: US 8,563,923 B2
(45) Date of Patent: Oct. 22, 2013

(54) ORTHOGONAL ACCELERATION TIME-OF-FLIGHT MASS SPECTROMETER

(75) Inventor: Takaya Satoh, Tokyo (JP)

(73) Assignee: JEOL Ltd., Tokyo (JP)

( * ) Notice: Subject to any disclaimer, the term of this patent is extended or adjusted under 35 U.S.C. 154(b) by 737 days.

(21) Appl. No.: 12/269,259

(22) Filed: Nov. 12, 2008

(65) Prior Publication Data

US 2009/0121130 A1 May 14, 2009

(30) Foreign Application Priority Data

Nov. 13, 2007 (JP) ..... 2007-294272

(51) Int. Cl.
*H01J 49/40* (2006.01)

(52) U.S. Cl.
USPC ..... 250/287; 250/281; 250/286

(58) Field of Classification Search
None
See application file for complete search history.

(56) References Cited

U.S. PATENT DOCUMENTS

| | | | | |
|---|---|---|---|---|
| 5,206,506 | A * | 4/1993 | Kirchner | 250/281 |
| 6,040,575 | A * | 3/2000 | Whitehouse et al. | 250/288 |
| 6,204,500 | B1 * | 3/2001 | Whitehouse et al. | 250/287 |
| 6,600,155 | B1 * | 7/2003 | Andrien et al. | 250/287 |
| 6,872,941 | B1 * | 3/2005 | Whitehouse et al. | 250/288 |
| 2002/0100870 | A1 * | 8/2002 | Whitehouse et al. | 250/281 |
| 2002/0117616 | A1 * | 8/2002 | Vestal | 250/287 |
| 2005/0258364 | A1 * | 11/2005 | Whitehouse et al. | 250/292 |
| 2005/0269508 | A1 * | 12/2005 | Lippa et al. | 250/292 |
| 2006/0076482 | A1 * | 4/2006 | Hobbs et al. | 250/287 |
| 2007/0194223 | A1 * | 8/2007 | Sato et al. | 250/287 |

FOREIGN PATENT DOCUMENTS

| | | | | |
|---|---|---|---|---|
| JP | 3354427 | * | 10/1998 | 250/281 |
| JP | 3354427 | B2 * | 12/2002 | H01J 49/40 |

* cited by examiner

*Primary Examiner* — Andrew Smyth
(74) *Attorney, Agent, or Firm* — The Webb Law Firm

(57) ABSTRACT

An orthogonal acceleration time-of-flight mass spectrometer has: an ion source for ionizing a sample; a conductive box into which the ions are introduced; ion acceleration device causing the ions to be accelerated in a pulsed manner in synchronism with a signal giving a starting point of measurement; and ion detector for detecting the ions in synchronism with the acceleration of the ions. The conductive box is provided with an ion injection port and an ion exit port. A lift voltage is applied to the conductive box. This voltage is switched in synchronism with the signal giving the starting point of the measurement.

11 Claims, 7 Drawing Sheets

ORTHOGONAL ACCELERATION TIME-OF-FLIGHT MASS SPECTROMETER

BACKGROUND OF THE INVENTION

1. Field of the Invention

The present invention relates to an orthogonal acceleration time-of-flight mass spectrometer for use in quantitative analysis of trace compounds, qualitative simultaneous analysis of trace compounds, and structural analysis of sample ions.

2. Description of Related Art

[Time-of-Flight Mass Spectrometer (TOFMS)]

A time-of-flight mass spectrometer is an apparatus for finding the mass-to-charge ratios of ions from the times taken for the ions to reach a detector after a given amount of energy is given to the ions such that they accelerate and fly. In TOFMS, ions are accelerated by a constant pulsed voltage $V_a$. At this time, the velocity v of each ion is given as follows from the law of energy conservation:

$$mv^2/2=qeV_a \quad (1)$$

$$v=\sqrt{(2qeV/m)} \quad (2)$$

where m is the mass of the ion, q is the electric charge of the ion, and e is the elementary electric charge. The ion reaches a detector spaced a given distance of L after a lapse of time T (flight time).

$$T=L/v=L\sqrt{(m/2qeV)} \quad (3)$$

It can be seen from Eq. (3) that the flight time T varies depending on the mass m of the ion. TOFMS is an apparatus that isolates masses utilizing this fact. One example of linear TOFMS is shown in FIG. 1. Furthermore, reflectron TOFMS has enjoyed wide acceptance because the apparatus permits improvement of energy convergence and increase in flight distance by placing a reflectron field between an ion source and a detector. One example of reflectron TOFMS is shown in FIG. 2.

[Orthogonal Acceleration TOFMS]

TOFMS must accelerate ions in a pulsed manner by the ion accelerating region in order to analyze variations in mass-to-charge ratio as the elapsed times from a starting point in time. Therefore, TOFMS has very good compatibility with an ionization method in which pulsed ionization is performed, such as by laser irradiation. However, mass spectrometry ionization methods include numerous ionization methods for producing ions continuously such as electron impact (EI) ionization, chemical ionization (CI) ionization, electrospray ionization (ESI), and atmospheric-pressure chemical ionization (APCI). Orthogonal acceleration time-of-flight mass spectrometry has been developed to combine these ionization methods with TOFMS.

FIG. 3 conceptually illustrates TOFMS using an orthogonal acceleration method (i.e., orthogonal acceleration TOFMS). An ion beam created from an ion source that creates ions continuously is conveyed with kinetic energies of tens of kV continuously to an orthogonal acceleration region. In the orthogonal acceleration region, a pulsed voltage of about 10 kV is applied such that the ions are accelerated in a direction orthogonal to the direction in which the ions are conveyed from the ion source. The times taken for the ions to reach the detector after the application of the pulsed voltage are different according to the masses of the ions. Thus, mass separation is performed. See Japanese Patent No. 3,354,427.

PROBLEM WITH THE PRIOR ART

Orthogonal acceleration TOFMS has a merit: the ion source can be installed at close to the ground potential. Therefore, in the flight space of the TOFMS, positive ions are floated at voltages of about −5 to −10 kV. There is the problem that these voltages are often limited by the voltage withstanding characteristics of the detector.

Furthermore, there is a method of coupling a floated detector to a data collection system that is at ground potential by the use of capacitors. In this method, if high-intensity ions are detected, the baseline of the spectrum sags immediately thereafter. This presents the problem that the quantitativeness is severely deteriorated.

SUMMARY OF THE INVENTION

In view of the foregoing, it is an object of the present invention to provide an orthogonal acceleration TOFMS that is not affected by the voltage withstanding performance of the ion detector. The problem with the conventional orthogonal acceleration (oa-) TOFMS can be solved by introducing a potential lifting mechanism immediately ahead of the TOF acceleration region of the oa-TOFMS. This yields the following advantages:

(1) The ion source and detection system can be placed at close to ground potential and so it is easy to handle the apparatus.

(2) Because the performance of TOFMS is affected by values obtained by dividing the initial energies creating a distribution by the accelerating voltage, if the initial energies are uniform across the ion acceleration region, those values can be reduced by setting the accelerating voltage to a higher value.

(3) It can be expected that the sensitivity of the detector will be improved by removing the restrictions imposed on the ion acceleration voltage.

(4) It is possible to avoid the problem with the capacitive coupling of the conventional detection system in which the voltage is floated. The quantitativeness can be improved.

This object is achieved in accordance with the teachings of the present invention by an orthogonal acceleration TOFMS having: an ion source for ionizing a sample; a conductive box into which the created ions are introduced; ion acceleration device placed inside or behind the conductive box and causing the ions to be accelerated in a pulsed manner in synchronism with a signal giving a starting point of measurement; and ion detection device for detecting the ions in synchronism with the acceleration of the ions. The conductive box is provided with an ion injection port and an ion exit port. A voltage is applied to the conductive box. This voltage is switched in synchronism with the signal giving the starting point of the measurement.

In one feature of the present invention, after the ions enter the conductive box, the switching permits the voltage to be applied to the box. After the ions leave the conductive box, the switching ceases the application of the voltage to the box.

In another feature of the present invention, ion guides for preventing diffusion of the ions are mounted inside the conductive box.

In a further feature of the present invention, ion beam compression device for compressing the ion beam in the direction of flight of ions is mounted inside the conductive box.

In still another feature of the present invention, an ion reflectron field is formed between the ion acceleration device and the ion detection device.

In an additional feature of the invention, an electric sector field is formed between the ion acceleration device and the ion detection device.

In yet another feature of the present invention, when no potential is applied to the box, the conductive box and the ion source are substantially at equipotential. When a potential is permitted to be applied to the box, the potential of the same polarity as the polarity of analyzed ions is applied.

In still an additional feature of the present invention, when no potential is applied to the conductive box, both the conductive box and ion source are at close to ground potential.

In a further additional feature of the present invention, when a potential is permitted to be applied to the conductive box, if ions to be analyzed are positive ions, the potential at the conductive box is less than +10 kV.

In an additional feature of the present invention, when a potential is permitted to be applied to the conductive box, if ions to be analyzed are negative ions, the potential at the conductive box is less than −10 kV.

In an additional feature of the present invention, when ions are accelerated, a voltage of about 10 kV or higher having the same polarity as the ions is applied to the ion acceleration device.

The orthogonal acceleration TOFMS according to the present invention has: an ion source for ionizing a sample; a conductive box into which the created ions are introduced; ion acceleration device placed inside or behind the conductive box and causing the ions to be accelerated in a pulsed manner in synchronism with a signal giving a starting point of measurement; and ion detection device for detecting ions in synchronism with the acceleration of the ions. The conductive box is provided with an ion injection port and an ion exit port. A voltage is applied to the conductive box. This voltage is switched in synchronism with the signal giving the starting point of the measurement. Consequently, it is possible to provide the orthogonal acceleration TOFMS not affected by the voltage withstanding performance of the ion detection device.

These and other objects and advantages of the present invention will become more apparent as the following description proceeds.

DESCRIPTION OF THE PREFERRED EMBODIMENTS

The preferred embodiments of the present invention are hereinafter described with reference to the drawings. In all the embodiments described below, it is assumed that positive ions are measured. Negative ions can be measured by reversing the polarity of the voltage. Furthermore, in all the embodiments described below, a reflectron TOFMS in which a reflectron field is placed between an ion acceleration region and a detector is taken as an example. The present invention can be applied to any type of TOFMS including linear TOFMS having no reflectron field and spiral TOFMS in which at least one electric sector field is placed between an ion acceleration region and a detector. In addition, in all the embodiments described below, ions are pushed by pulsed accelerating electrodes. If an equivalent electric accelerating field is obtained, ions may be extracted by disposing pulsed accelerating electrodes closer to the detector than the ion beam entrance position. Alternatively, repeller pulsed electrodes and extraction pulsed electrodes may be arranged on the opposite sides of the ion beam entrance position.

Embodiment 1

FIGS. 4-8 show a first embodiment (Embodiment 1) of the present invention. In the present embodiment, a TOFMS orthogonal acceleration region is accommodated in a metallic box to which a voltage, known as potential lift, can be applied. The potential across the metallic box is uniform. The potential-lift wall surfaces of the portions opposite to the ion beam entrance path and of the portions of the pulsed acceleration region 2 from which ions exit are made of a mesh. This TOFMS is similar in configuration to the conventional reflectron TOFMS in other respects.

Figure 1:
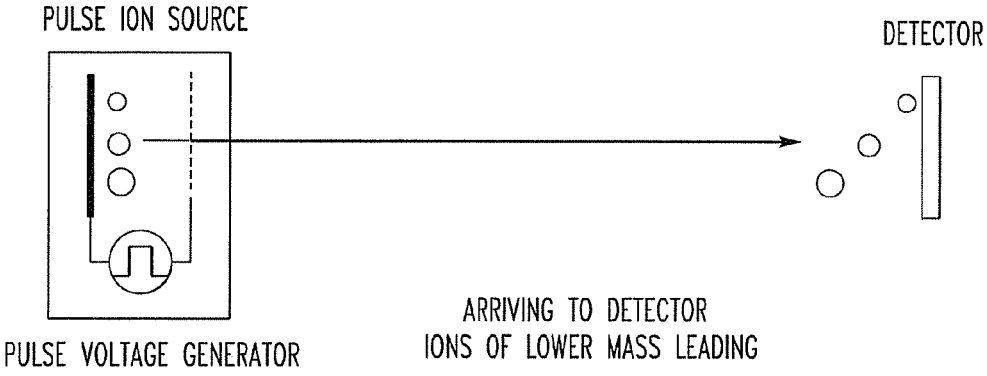
FIG.1 PRIOR ART
FIG. 1 is a diagram of one conventional linear TOF (time-of-flight) mass spectrometer.
Figure 2:
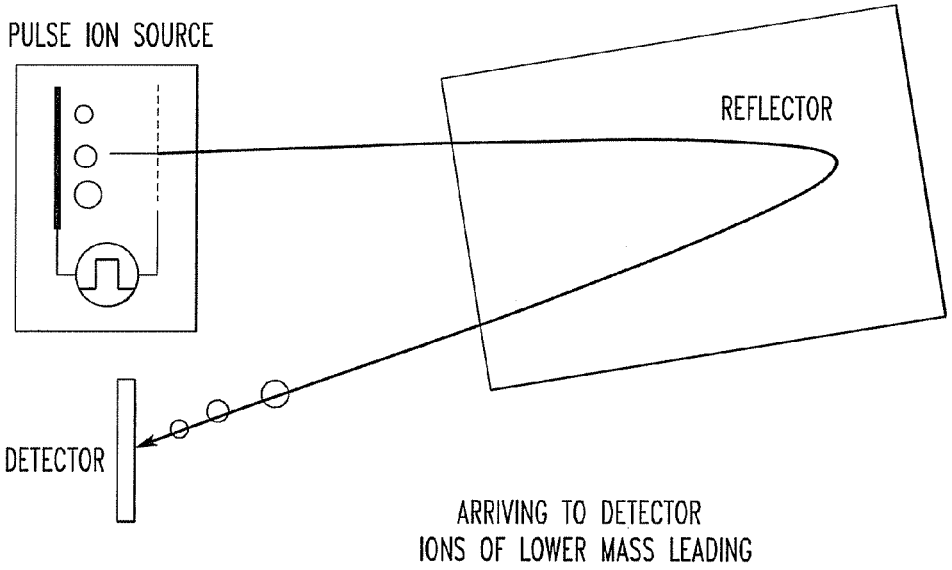
FIG.2 PRIOR ART
FIG. 2 is a diagram of a conventional reflectron TOF mass spectrometer.
Figure 3:
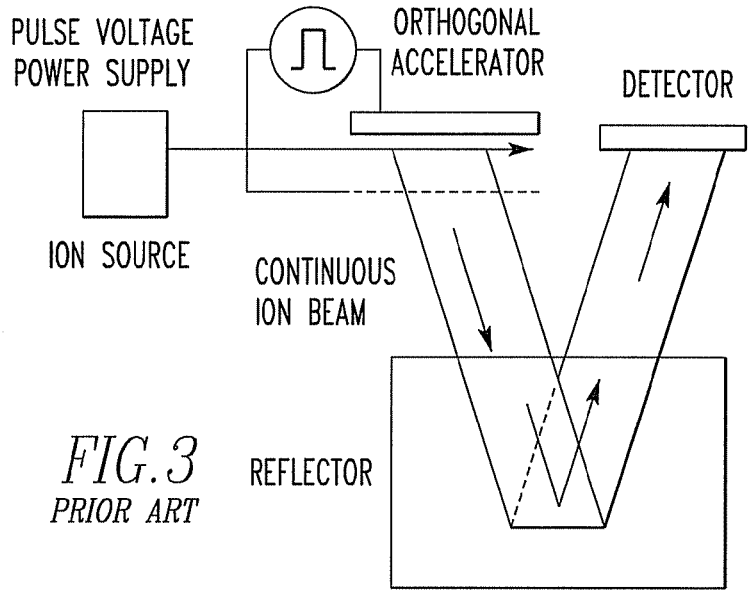
FIG. 3 PRIOR ART
FIG. 3 is a diagram of a conventional reflectron, orthogonal acceleration TOF mass spectrometer.
Figure 4:
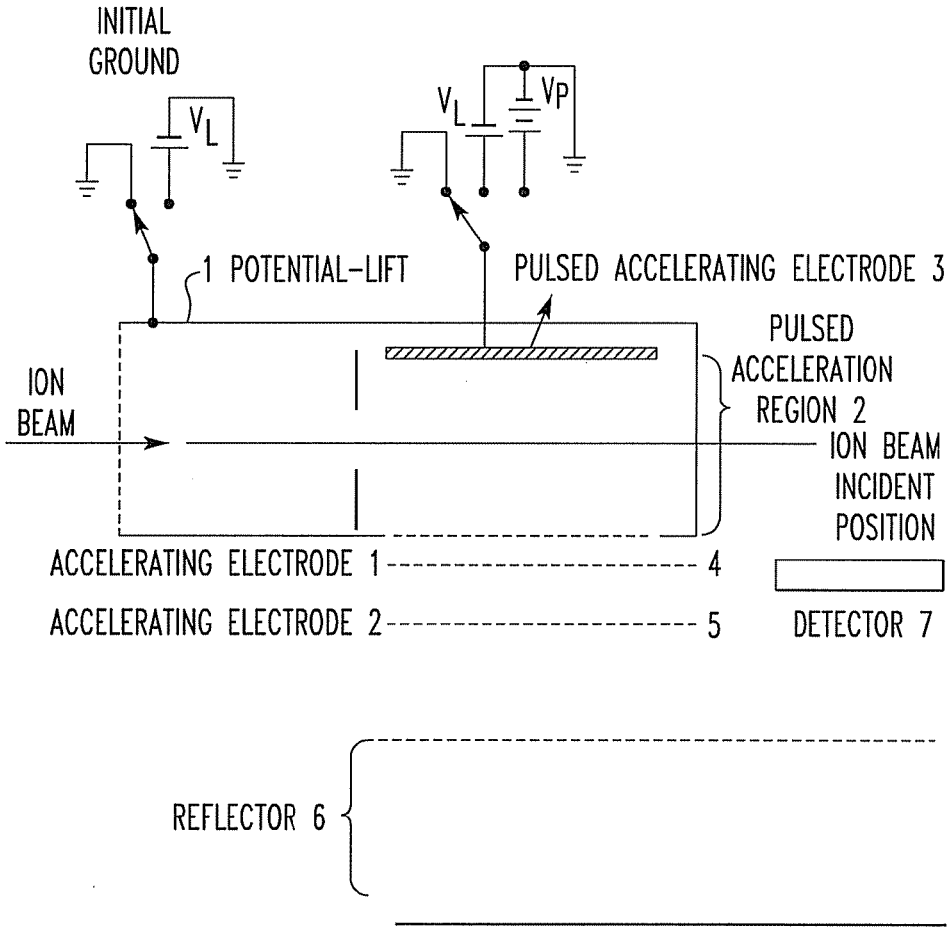
FIG. 4 is a diagram of one TOF mass spectrometer according to the present invention.

The present embodiment operates as follows. First, as shown in FIG. 4, an ion beam produced from an ion source (not shown) that creates ions continuously reaches a potential lift mechanism 1 via an ion transport system including ion guides (not shown).

The ion source, ion transport system, potential lift mechanism 1, and a pulsed accelerating electrode 3 are at close to ground potential. The ion beam can smoothly enter the potential lift mechanism 1 through the mesh.

Figure 5:
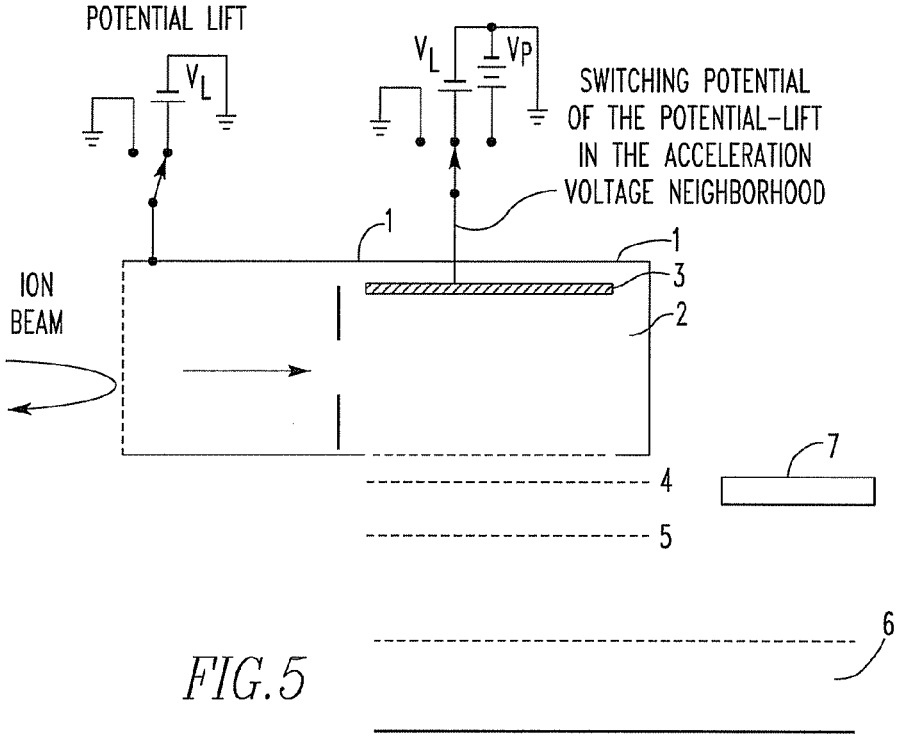
FIG. 5 is a diagram of another TOF mass spectrometer according to the present invention.
Figure 8:
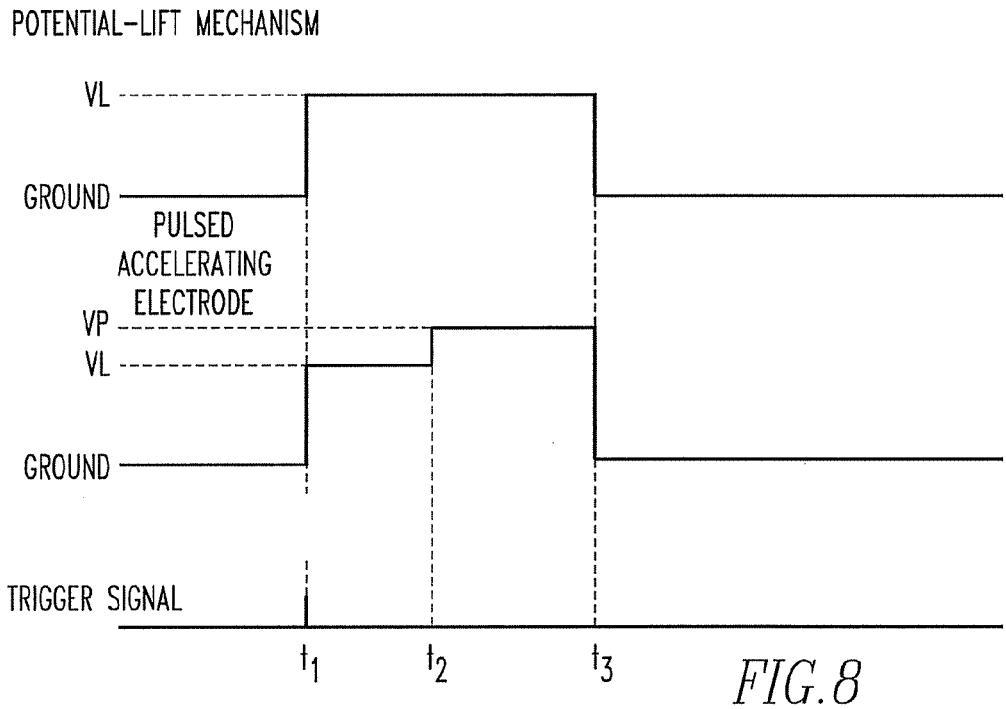
FIG. 8 is a diagram illustrating one method of controlling potentials in a TOF mass spectrometer in accordance with the present invention.

Then, as shown in FIGS. 5 and 8, at an instant of time $t_1$, the ion beam has entered to some extent. At this instant, a trigger signal is produced. In synchronism with the trigger signal, a voltage is applied to the potential lift mechanism 1. The potential is increased from ground potential to $V_L$ (about +10 kV) in a short time. This increases the potential of ions inside the potential lift mechanism 1 to $V_L$. During this interval, the ion beam from the ion source is reflected by the mesh disposed at the entrance to the potential lift mechanism 1. Thus, the beam cannot enter the potential lift mechanism 1. At this time, the voltage of $V_L$ is applied to the pulsed accelerating electrode 3 in synchronism with the application of the voltage to the potential lift mechanism 1.

Figure 6:
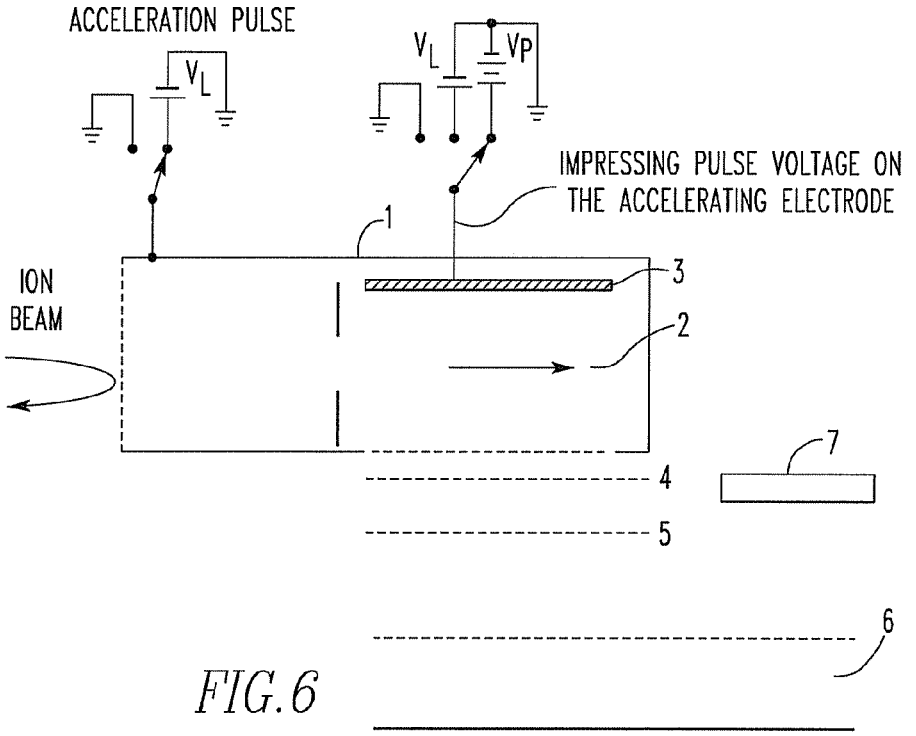
FIG. 6 is a diagram of a further TOF mass spectrometer according to the present invention.
Figure 7:
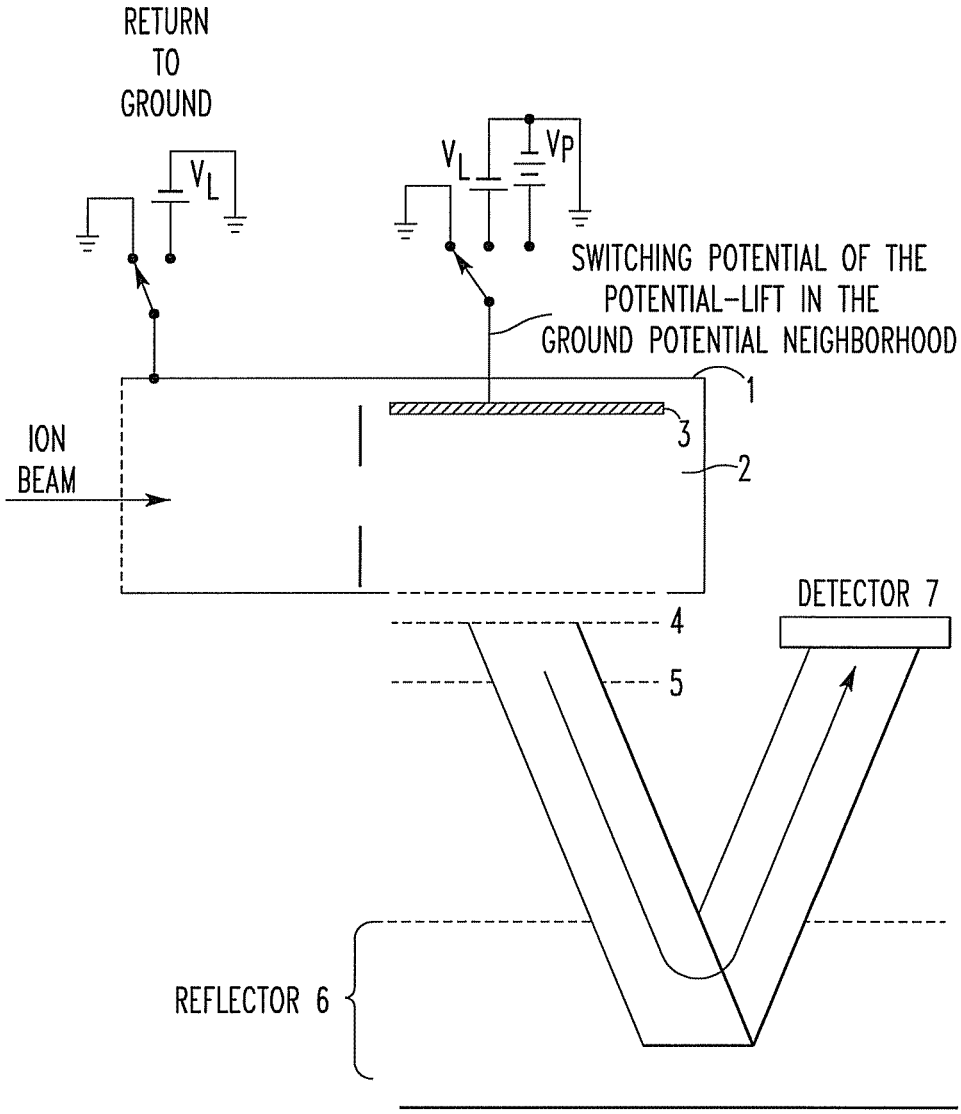
FIG. 7 is a diagram of still another TOF mass spectrometer according to the present invention.

Then, as shown in FIGS. 6 and 8, the ion beam in the potential lift mechanism 1 whose potential has been increased to $V_L$ goes further and reaches the pulsed acceleration region 2. The ion beam reaches the pulsed acceleration region 2 at the instant of time of $t_2$. If a pulsed voltage of $V_P$ is applied to the pulsed accelerating electrode 3 at the instant $t_2$, the ion beam passes through the mesh and is pushed out of the potential lift mechanism 1, and then measurement of the flight times of the ions is started. The voltage $V_P$ is so set that $V_P-V_L$ is higher than 1 kV and lower than 10 kV.

When the pulsed voltage $V_P$ is applied to the pulsed accelerating electrode 3, the ion beam is accelerated when it passes through the region surrounded by the pulsed acceleration electrode 3 set to $V_P$, a first accelerating electrode 4 held to a voltage close to $V_L$, and a second accelerating electrode 5 held close to ground potential. The beam is reflected by a reflectron field 6 and reaches a detector 7.

Then, as shown in FIG. 8, the potential at the potential lift mechanism 1 may be returned to ground potential at an instant of time $t_3$, i.e., after the ion beam has passed through the first accelerating electrode 4. In consequence, the ion beam from the ion source again passes through the mesh on the potential lift mechanism 1 and begins to pass into the potential lift mechanism 1. The potential at the pulsed accelerating electrode 3 is again returned to the potential close to ground potential in synchronism with variation in potential at the potential lift mechanism 1.

Eventually, the potentials at the potential lift mechanism 1 and pulsed accelerating electrode 3 vary repeatedly as each flight time measurement is made as shown in FIG. 8. Successive ion flight time measurements can be performed by repeating the operations described so far.

Embodiment 2

Figure 9:
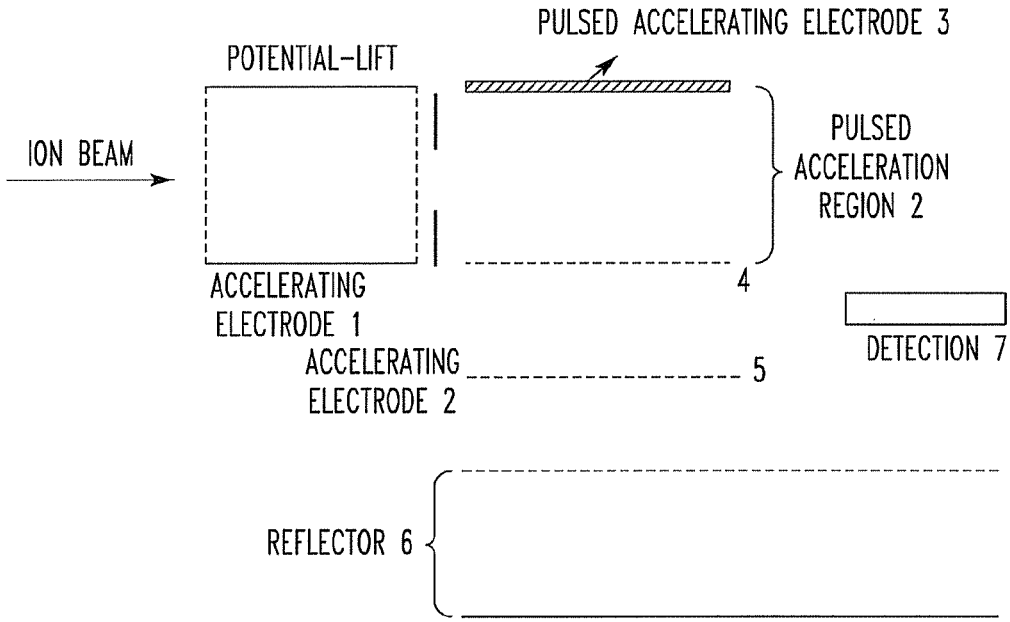
FIG. 9 is a diagram illustrating another TOF mass spectrometer according to the present invention.

FIG. 9 illustrates a second embodiment of the present invention. In the present embodiment, a metallic box to which a voltage, known as potential lift, can be applied is placed ahead of the orthogonal acceleration region of a TOFMS. Potential across the metallic box is uniform. The potential at the ion acceleration region 2 is previously set close to the accelerating potential. An ion transport system, such as ion guides, may be mounted in the potential lift mechanism. The TOFMS of the second embodiment is similar to the reflectron TOFMS of the first embodiment in other respects.

Figure 10:
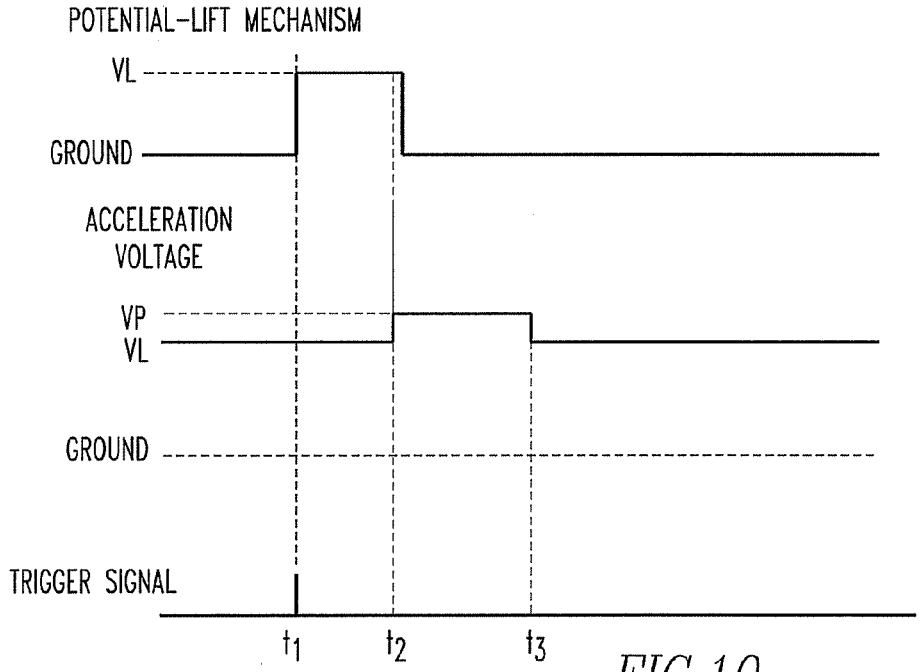
FIG. 10 is a timing chart illustrating another method of controlling potentials in a TOF mass spectrometer in accordance with the present invention.

The present embodiment is described by referring to the timing chart of FIG. 10. An ion beam produced from an ion source (not shown) that creates ions continuously reaches the potential lift mechanism 1 via an ion transport system including ion guides (not shown). The potential-lift wall surfaces of the portions opposite to the ion beam entrance path and of the portions opposite to the pulsed acceleration region 2 are made of a mesh.

The ion source, ion transport system, and potential lift mechanism 1 are set close to ground potential. The ion beam can smoothly enter the potential lift mechanism 1 through the mesh. At this time, a voltage of $V_L$ (about +10 kV) is applied to the pulsed accelerating electrode 3 and to the first accelerating electrode 4.

Then, at the instant of time $t_1$, the ion beam has entered to some extent. At this instant, a trigger signal is produced. In synchronism with the trigger signal, a voltage is applied to the potential lift mechanism 1. The potential is increased from ground potential to $V_L$ in a short time. This increases the potential of ions inside the potential lift mechanism 1 to $V_L$. During this interval, the ion beam from the ion source is reflected by the mesh disposed at the entrance to the potential lift mechanism. Thus, the beam cannot enter the potential lift mechanism 1.

Then, the ion beam in the potential lift mechanism 1 whose potential has been increased to $V_L$ goes further and reaches the pulsed acceleration region 2. Because the potential lift mechanism 1 and pulsed acceleration region 2 are at the potential $V_L$, the ion beam smoothly moves from the potential lift mechanism 1 toward the pulsed acceleration region 2.

The ion beam reaches the pulsed acceleration region 2 at the instant of time of $t_2$. If a pulsed voltage of $V_P$ of about +10 kV or higher is applied to the pulsed accelerating electrode 3 at the instant $t_2$, the ion beam passes through the mesh and is pushed out of the ion acceleration region 2, and then measurement of the flight times of the ions is started.

Then, the potential at the potential lift mechanism 1 may be returned to ground potential at the instant of time $t_3$, i.e., after the ion beam has passed through the first accelerating electrode 4. In consequence, the ion beam from the ion source again passes through the mesh on the potential lift mechanism 1 and begins to pass into the potential lift mechanism 1.

When the pulsed voltage VP is applied to the pulsed accelerating electrode 3, the ion beam is accelerated when it passes through the region surrounded by the pulsed acceleration electrode 3 set to $V_P$, first accelerating electrode 4 held to a voltage close to $V_L$, and second accelerating electrode 5 held close to ground potential. The beam is reflected by the reflectron field and reaches the detector 7. After the ions exit from the ion acceleration region 3, the potential at the pulsed accelerating electrode 3 is returned to $V_L$.

Eventually, the potentials at the potential lift mechanism 1 and pulsed accelerating electrode 3 vary repeatedly as each flight time measurement is made as shown in FIG. 10. Successive ion flight time measurements can be performed by repeating the operations described so far.

Embodiment 3

The present embodiment provides modifications of Embodiments 1 and 2. Ion beam transport apparatus including lenses is disposed in the potential lift mechanism.

Embodiment 4

The present embodiment provides modifications of Embodiments 1 to 3. Ion beam compression device capable of applying a pulsed voltage in the direction of transportation of a continuous beam is mounted for the lenses in the potential lift mechanism.

Figure 11:
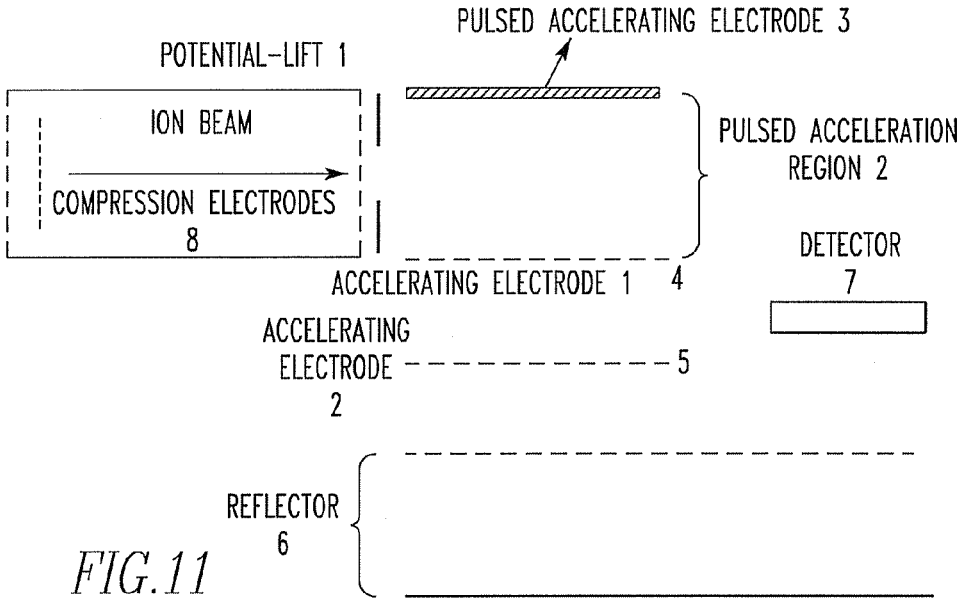
FIG. 11 is a diagram of a still further TOF mass spectrometer according to the present invention.
Figure 12:
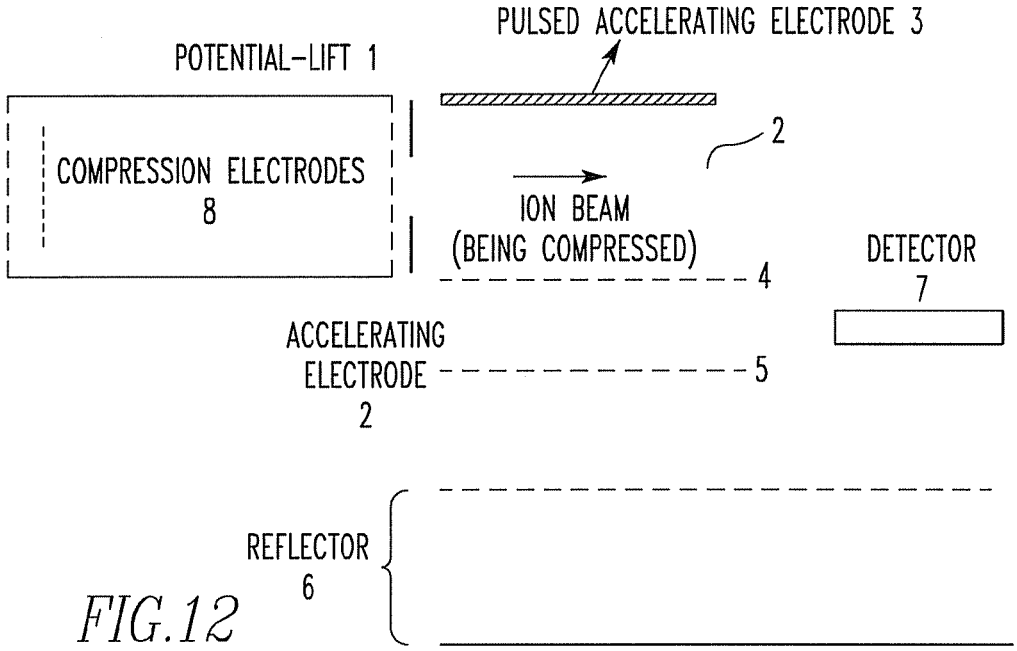
FIG. 12 is a diagram of an additional TOF mass spectrometer according to the present invention.
Figure 13:
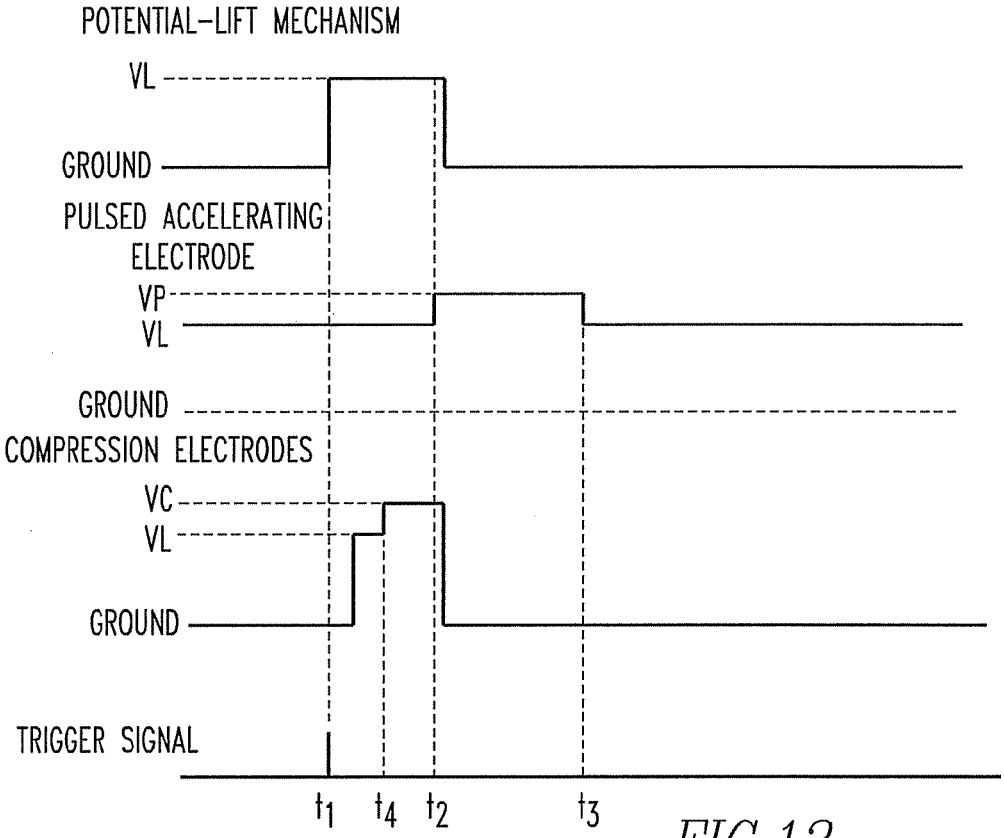
FIG. 13 is a diagram illustrating a further method of controlling potentials in a TOF mass spectrometer in accordance with the present invention.

FIGS. 11-13 show the fourth embodiment of the present invention. In the present embodiment, a metallic box to which a voltage, known as potential lift, can be applied is placed ahead of the orthogonal acceleration region of a TOFMS. Potential across the metallic box is uniform. Compression electrodes for compressing the ion beam in the direction of the axis of the beam are mounted in the box. The compression electrodes are made of a planar mesh parallel to the plane perpendicular to the axis of the ion beam. This TOFMS is similar in configuration with the reflectron TOFMS of Embodiment 1 in other respects.

The present embodiment operates as follows. First, an ion beam produced from an ion source (not shown) that creates ions continuously reaches the potential lift mechanism 1 via the ion transport system including ion guides (not shown). The potential-lift wall surfaces of the portions opposite to the ion beam entrance path and of the portions opposite to the pulsed accelerating region 2 are made of a mesh.

The ion source, ion transport system, and potential lift mechanism 1 are set close to ground potential. The ion beam can smoothly enter the potential lift mechanism 1 through the mesh. At this time, the voltage $V_L$ is applied to the pulsed accelerating electrode 3 and to the first accelerating electrode 4.

Then, at the instant of time $t_1$, the ion beam has entered to some extent. At this instant, a trigger signal is produced. In synchronism with the trigger signal, a voltage is applied to the potential lift mechanism 1. The potential is increased from ground potential to $V_L$ (about +10 kV) in a short time. This increases the potential of ions inside the potential lift mechanism 1 to $V_L$. During this interval, the ion beam from the ion source is reflected by the mesh disposed at the entrance to the potential lift mechanism. Thus, the beam cannot enter the potential lift mechanism 1.

Then, a pulsed voltage of $V_C$ ($V_L$+tens of V (i.e., higher than 10 V and lower than 100V)) is applied to the compression electrodes 8 at the same time when the potential at the potential lift mechanism 1 is increased to $V_L$ or at instant $t_4$ (i.e., slightly later) to accelerate the ions toward the ion acceleration region 2. The pulsed voltage $V_C$ is so set as to substantially balance the ion transport energies of tens of eV.

The ion beam moves through the potential lift mechanism 1 while at the increased potential $V_L$. As the beam is closer to the compression electrode 8 (i.e., more remote from the pulsed acceleration region 2), the beam acquires higher kinetic energy. Then, the beam enters the ion acceleration region 2, where the beam can be compressed in the direction of the axis of the beam.

That is, if the potential lift mechanism 1 is designed to be longer than the ion acceleration region 2 in the direction of axis of the beam, the ion beam that is spatially larger than the intrinsic space of the ion acceleration region 2 can be used for flight time measurements as shown in FIG. 12. Hence, the efficiency of utilization of the ions is improved.

If a pulsed voltage of $V_P$ of about +10 kV or higher is applied to the pulsed accelerating electrode 3 at the instant $t_2$ when the ion beam reaches the pulsed acceleration region 2, the ion beam passes through the mesh and is pushed out of the ion acceleration region 2, and then measurement of the flight times of the ions is started.

The potential at the potential lift mechanism 1 may be again returned to ground potential after the ion beam has passed through the first accelerating electrode 4. In consequence, the ion beam from the ion source again passes through the mesh on the potential lift mechanism 1 and begins to pass into the potential lift mechanism 1.

When the pulsed voltage $V_P$ is applied to the pulsed accelerating electrode 3, the ion beam is accelerated when it passes through the region surrounded by the pulsed acceleration electrode 3 set to $V_P$, first accelerating electrode 4 held to a voltage close to $V_L$, and second accelerating electrode 5 held close to ground potential. The beam is reflected by the reflectron field 6 and reaches the detector 7. After the ions exit from the ion acceleration region 2, the potential at the pulsed accelerating electrode 3 is again returned to $V_L$.

Eventually, the potentials at the potential lift mechanism 1 and pulsed accelerating electrode 3 vary repeatedly as each flight time measurement is made as shown in FIG. 13. Successive ion flight time measurements can be performed by repeating the operations described so far.

The present invention can find wide acceptance in orthogonal acceleration TOF mass spectrometry.

Having thus described my invention with the detail and particularity required by the Patent Laws, what is desired protected by Letters Patent is set forth in the following claims.

The invention claimed is:

1. An orthogonal acceleration TOF mass spectrometer having an orthogonal acceleration region into which ions are conveyed from a source in a first direction and then from which ions are accelerated in a second direction orthogonal to the first direction toward a detection means via a mass separation region comprising:

said ion source for ionizing a sample to create a continuous beam of ions travelling in said first direction;

a conductive box provided with an ion injection port and an ion exit port, said conductive box enclosing the orthogonal acceleration region and defining a lift region into which the created continuous beam of ions travelling in said first direction are introduced via the injection port;

ion acceleration means placed inside or behind the conductive box and controlled to cause the ions to be accelerated in said second direction out of said conductive box and lift region via the exit port into said mass separation region in a pulsed manner in synchronism with a signal giving a starting point of measurement; and said ion detection means controlled to detect the ions in synchronism with the acceleration of the ions, and means for applying a lift voltage to the conductive box, controlled such that the lift voltage is applied at an instant of time after the continuous beam has entered the conductive box and prior to the acceleration of ions caused by said ion acceleration means.

2. An orthogonal acceleration TOF mass spectrometer as set forth in claim 1, wherein after the ions enter the conductive box, said switching permits the voltage to be applied to the box, and wherein after the ions leave the conductive box, said switching ceases the application of the voltage to the box.

3. An orthogonal acceleration TOF mass spectrometer as set forth in claim 1, wherein ion guides for preventing diffusion of the ions are mounted inside the conductive box.

4. An orthogonal acceleration TOF mass spectrometer as set forth in claim 1, wherein ion beam compression means for compressing the ion beam in the direction of flight of ions is mounted inside the conductive box.

5. An orthogonal acceleration TOF mass spectrometer as set forth in claim 1, wherein an ion reflectron field is formed between said ion acceleration means and said ion detection means.

6. An orthogonal acceleration TOF mass spectrometer as set forth in claim 1, wherein an electric sector field is formed between said ion acceleration means and said ion detection means.

7. An orthogonal acceleration TOF mass spectrometer as set forth in claim 1, configured such that when no potential is applied to the box, the conductive box and the ion source are substantially at equipotential, and such that when the potential is permitted to be applied to the box, the potential of the same polarity as the polarity of analyzed ions is applied.

8. An orthogonal acceleration TOF mass spectrometer as set forth in claim 7, configured such that when no potential is applied to the conductive box, both of the conductive box and the ion source are at close to ground potential.

9. An orthogonal acceleration TOF mass spectrometer as set forth in claim 7, configured such that when the potential is permitted to be applied to the conductive box, if ions to be analyzed are positive ions, the potential at the conductive box is about +10 kV.

10. An orthogonal acceleration TOF mass spectrometer as set forth in claim 7, configured such that when a potential is permitted to be applied to the conductive box, if ions to be analyzed are negative ions, the potential at the conductive box is about −10 kV.

11. An orthogonal acceleration TOF mass spectrometer as set forth in claim 1, configured such that when ions are accelerated, a voltage of about 10 kV or higher having the same polarity as the ions is applied to the ion acceleration means.

* * * * *